US011761734B2

(12) United States Patent
Chen et al.

(10) Patent No.: US 11,761,734 B2
(45) Date of Patent: Sep. 19, 2023

(54) FLASHLIGHT WITH LATERAL LOCKING FUNCTION FOR FIREARMS

(71) Applicant: Shenzhen YingLu Technology Development Co., Ltd, Shenzhen (CN)

(72) Inventors: Guozheng Chen, Lufeng (CN); Bilan Pan, Lufeng (CN)

(73) Assignee: Shenzhen YingLu Technology Development Co., Ltd, Shenzhen (CN)

( * ) Notice: Subject to any disclaimer, the term of this patent is extended or adjusted under 35 U.S.C. 154(b) by 0 days.

(21) Appl. No.: 17/980,686

(22) Filed: Nov. 4, 2022

(65) Prior Publication Data

US 2023/0123768 A1 Apr. 20, 2023

Related U.S. Application Data

(63) Continuation of application No. PCT/CN2021/132598, filed on Nov. 24, 2021.

(30) Foreign Application Priority Data

Oct. 15, 2021 (CN) ..... 202111207263.6

(51) Int. Cl.
*F41G 1/35* (2006.01)

(52) U.S. Cl.
CPC ..... *F41G 1/35* (2013.01)

(58) Field of Classification Search
CPC ..... F41G 1/16; F41G 1/35
USPC ..... 42/114
See application file for complete search history.

(56) References Cited

U.S. PATENT DOCUMENTS

| | | | | |
|---|---|---|---|---|
| 11,231,253 | B2 * | 1/2022 | Miller | F41C 23/22 |
| 2011/0023348 | A1 | 2/2011 | Karagias | |
| 2013/0000176 | A1 * | 1/2013 | Goertzen | F41G 11/003 42/90 |
| 2017/0261288 | A1 * | 9/2017 | Bartoszewicz | F41G 11/003 |
| 2020/0208946 | A1 * | 7/2020 | Cahill | F41G 11/001 |
| 2021/0325149 | A1 * | 10/2021 | Johnson, Sr. | F41G 11/003 |
| 2022/0113114 | A1 * | 4/2022 | Humphries | F41G 1/01 |

(Continued)

FOREIGN PATENT DOCUMENTS

| | | | |
|---|---|---|---|
| CN | 102032840 | A | 4/2011 |
| CN | 206583353 | U | 10/2017 |
| CN | 107388897 | A | 11/2017 |

(Continued)

*Primary Examiner* — Samir Abdosh
(74) *Attorney, Agent, or Firm* — Jeenam Park

(57) ABSTRACT

A flashlight with lateral locking function for firearms, comprises: a flashlight body and a lateral locking mechanism, the lateral locking mechanism is used to fix the flashlight body to a firearm; the lateral locking mechanism comprises a bottom box and a connecting component, an adjustment component is arranged on the bottom box, the adjusting component is connected with the connecting component, and comprises an adjusting handle, the adjusting handle is connected with a side wall of the bottom box, using to drive the movement of the connecting component, so that the connecting component is connected or disconnected from the firearm. The disclosure realizes the quick installation and disassembly. The whole installation process does not need to use other tools such as wrenches, and the installation is firm; the adjusting handle is arranged on the side wall of the bottom box, which is convenient for users to operate.

8 Claims, 4 Drawing Sheets

(56) References Cited

U.S. PATENT DOCUMENTS

2023/0064118 A1* 3/2023 Stabler ..... F16B 2/12

FOREIGN PATENT DOCUMENTS

| | | | |
|---|---|---|---|
| CN | 109238011 | A | 1/2019 |
| CN | 110671964 | A | 1/2020 |
| CN | 213120283 | U | 5/2021 |

* cited by examiner

FLASHLIGHT WITH LATERAL LOCKING FUNCTION FOR FIREARMS

CROSS-REFERENCE TO RELATED APPLICATIONS

The present application is a 35 U.S.C. § 371 National Phase conversion of International (PCT) Patent Application No. PCT/CN2021/132598 filed Nov. 24, 2021, which claims foreign priority of Chinese Patent Application No. 202111207263.6, filed on Oct. 15, 2021 in the State Intellectual Property Office of China, the contents of all of which are hereby incorporated by reference.

TECHNICAL FIELD

The present disclosure relates to the technical filed of firearm accessories, and in particular to a flashlight with lateral locking function for firearms.

BACKGROUND

Firearms often need to increase accessory devices such as flashlights during use. How to effectively combine the flashlight with the firearm and easy for use is particularly important. There are two common fixing methods:

1. A dovetail socket is set on the barrel of the firearm, and a dovetail buckle is set at the bottom of the flashlight. When installing, snap the dovetail socket into the dovetail socket and push it to the designated position to lock it. In this way, you need to push the flashlight to the designated position to fix it. However, the flashlight often needs to be installed and disassembled. As the number of disassembly and assembly increases, the dovetail slot seat and the dovetail slot buckle will wear out, resulting in the flashlight cannot be installed firmly, affecting the use and reducing the service life.
2. Reserve screw holes on the barrel of the firearm, install the base on the flashlight, the flashlight is rotatably connected to the base through the hinge, fix the base and the barrel through the screw, and then flip the hinge to adjust the angle of the flashlight. In this way, a wrench is used for locking, which is inconvenient to install and disassemble; in addition, the hinge is prone to failure, resulting in an inaccurate angle of the flashlight, which affects the use.

SUMMARY

In view of the problems existing in the above-mentioned prior art. The present disclosure provides a flashlight with a lateral locking function for firearms, and specifically provides the following technical solutions:

A flashlight with lateral locking function for firearms, comprises: a flashlight body and a lateral locking mechanism, the flashlight body is connected with the lateral locking mechanism, and the lateral locking mechanism is used to fix the flashlight body to a firearm; the lateral locking mechanism comprises a bottom box and a connecting component, an upper surface of the bottom box is connected with the flashlight body, the connecting component passes through a lower surface of the bottom box, and the connecting component can be detachable connected with the firearm; an adjustment component is arranged on the bottom box, the adjusting component is connected with the connecting component, and comprises an adjusting handle, the adjusting handle is connected with a side wall of the bottom box, using to drive the movement of the connecting component, so that the connecting component is connected or disconnected from the firearm.

Further, the adjusting component comprises an adjusting rod, one end of the adjusting rod is connected with the adjusting handle, another end of the adjusting rod away from the adjusting handle passes through the side wall of the bottom box, and the outer wall of one end of the adjusting rod extending into the bottom box is arranged with an external thread.

Further, one end of the adjusting handle is in contact with the outer side wall of the bottom box, a circlip is sleeved on the adjusting rod, the circlip is in contact with the inner side wall of the bottom box, and another end of the adjusting rod away from the adjustment handle is arranged with a first bearing, and the first bearing is connected with the inner wall of the bottom box.

Further, the side wall of the adjusting handle is arranged with an anti-skid structure, and the end surface of the adjusting handle away from the bottom box is arranged with a long groove.

Further, the connecting component comprises a connecting rod and a fixing base, one end of the connecting rod is connected with the fixing base, and the fixing base is used for connecting with the firearm; another end of the connecting rod away from the fixing base passes through the lower surface of the bottom box, and the outer side of one end of the connecting rod that extends into the bottom box is sleeved with a gear, and the connecting rod can rotate with the gear, the gear meshes with the external thread.

Further, a second bearing is sleeved at one end of the connecting rod away from the fixing base, and the second bearing is connected with the inner wall of the bottom box.

Further, there are two adjustment components and two connection components respectively, and each adjustment handle is used to adjust a corresponding connection component.

Further, the flashlight body comprises a lamp cap, a barrel body and a back cover, two ends of the barrel body are respectively connected with the lamp cap and the back cover, and an outer wall of the barrel body is connected with the upper surface of the bottom box.

Further, the lamp cap is arranged with a light-emitting component, the barrel body is arranged with a power supply, and the back cover is arranged with a control switch, and the light-emitting component is respectively electrically connected with the power supply and the control switch.

Further, both ends of the barrel body are respectively sleeved with waterproof rings, and the waterproof rings are respectively sealed and connected with the lamp cap and the back cover.

Compared with the prior art, the present disclosure realizes the rapid installation and disassembly of the flashlight body and the firearm by the installation and fixation of the lateral locking mechanism and the firearm; the installation is firm, not easy to loosen, and can effectively prolong the service life of the flashlight. When installing the flashlight, place the connection component on the predetermined installation position on the firearm, and quickly complete the installation and fixation of the connection component and the firearm by adjusting the handle. The whole installation process does not require the use of other tools such as wrenches; and the adjustment handle is set on the side wall of the bottom box, it is convenient for the user to quickly complete the installation and disassembly of the flashlight.

BRIEF DESCRIPTION OF THE DRAWINGS

In order to more clearly illustrate the solutions in the present disclosure or the prior art, the following will briefly introduce the accompanying drawings that need to be used in the description of the embodiments or the prior art. Obviously, the drawings in the following description belong to the embodiments of the present disclosure. For those ordinary skill in the art, other drawings can also be obtained according to these drawings without any creative effort.

DETAILED DESCRIPTION

Unless otherwise defined, all technical and scientific terms used herein have the same meaning as commonly understood by one of ordinary skill in the art of this disclosure; terms used herein in the specification of the disclosure are for the purpose of describing particular embodiments only, is not intended to limit the application; the terms "comprising" and "including" and any variations thereof in the description and claims of this application and the above description of the drawings are intended to cover the non-exclusive inclusion. The terms "first", "second" and the like in the description and claims of the present application or the above drawings are used to distinguish different objects, rather than to describe a specific order.

Reference herein to an "embodiment" means that a particular feature, structure, or characteristic described in connection with the embodiment can be included in at least one embodiment of the present disclosure. The appearances of the phrase in various places in the specification are not necessarily all referring to the same embodiment, nor a separate or alternative embodiment that is mutually exclusive of other embodiments. It is explicitly and implicitly understood by those skilled in the art that the embodiments described herein may be combined with other embodiments.

In order to make those skilled in the art better understand the solutions of the present disclosure, the technical solutions in the embodiments of the present disclosure will be described clearly and completely below with reference to the accompanying drawings.

Figure 1:
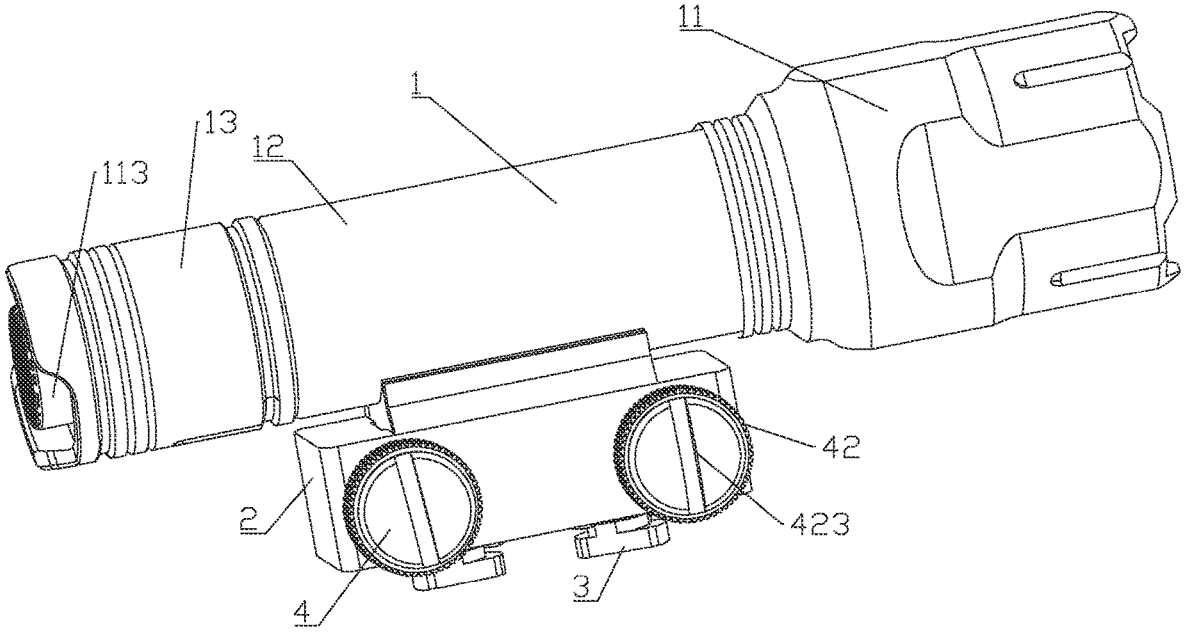
FIG. 1 is a schematic diagram of the overall structure according to an embodiment of the present disclosure.
Figure 2:
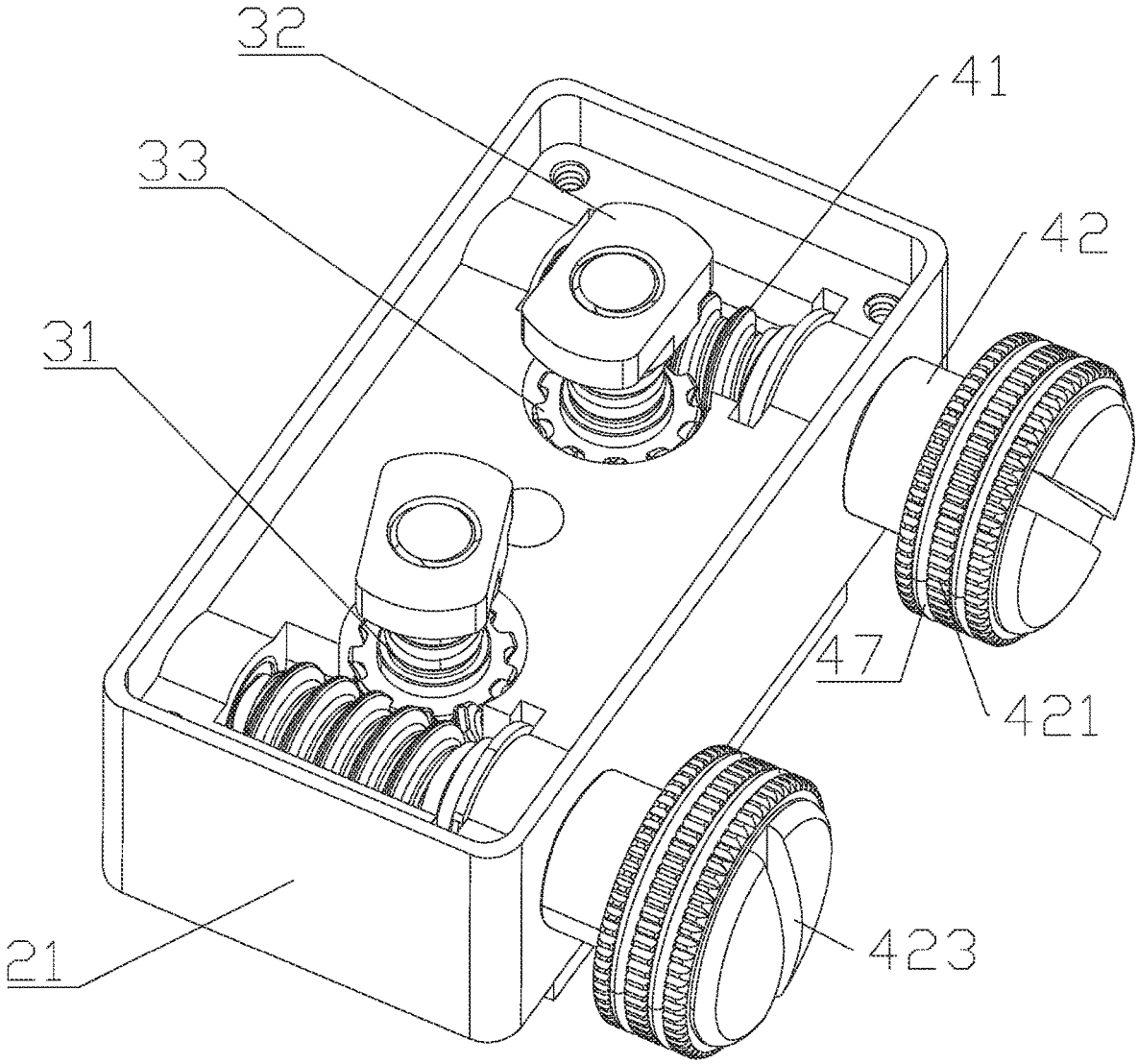
FIG. 2 is a schematic diagram of the internal structure of the lateral locking mechanism according to the embodiment of the present disclosure.
Figure 3:
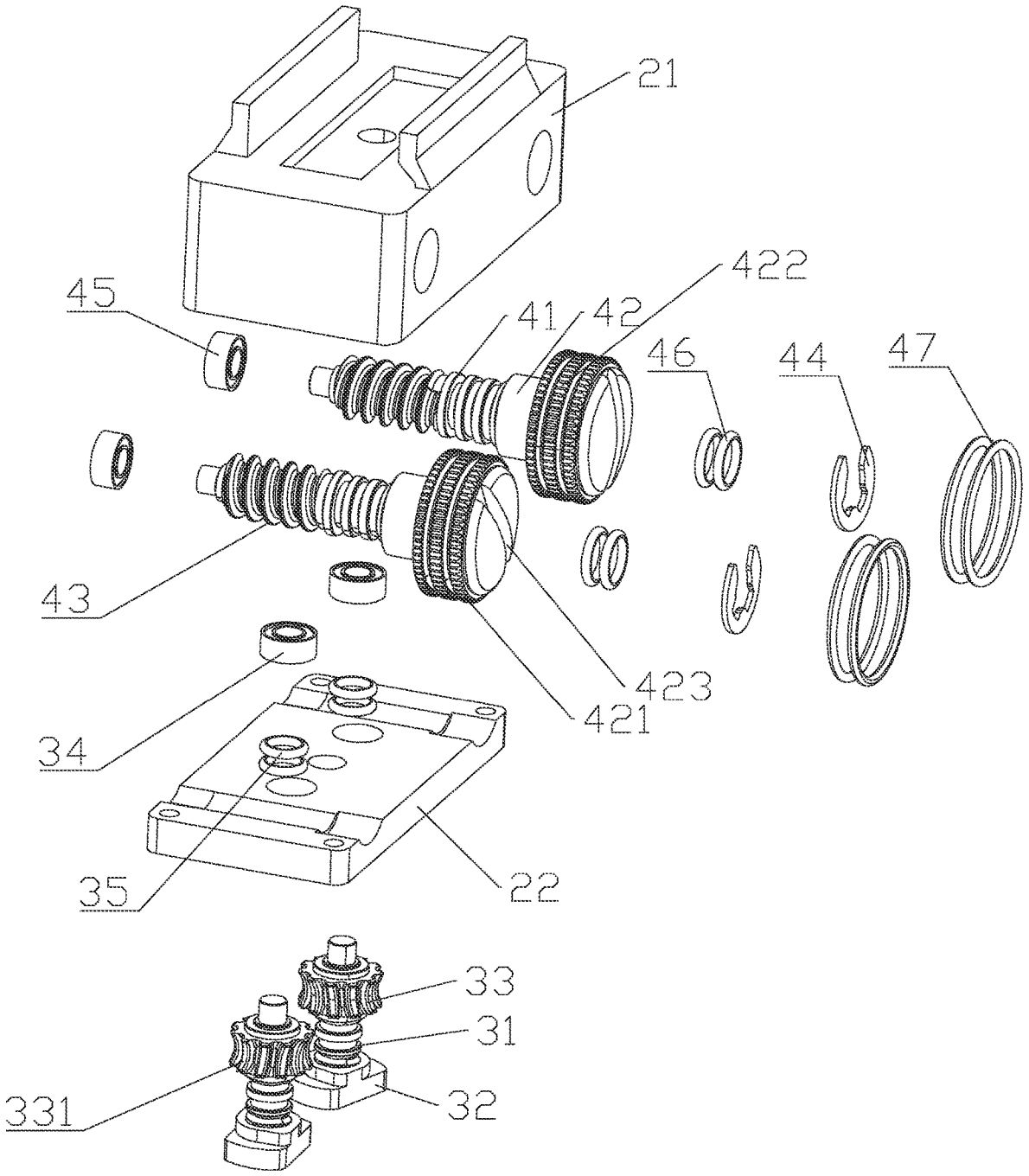
FIG. 3 is a schematic diagram of the exploded structure of the lateral locking mechanism according to the embodiment of the present disclosure.

As shown in FIG. 1-3, a flashlight with lateral locking function for firearms, comprises a flashlight body 1 and a lateral locking mechanism, the flashlight body 1 is connected with the lateral locking mechanism, and the lateral locking mechanism is used to fix the flashlight body 1 to a firearm.

The lateral locking mechanism comprises a bottom box 2 and a connecting component 3, an upper surface of the bottom box 2 is connected with the flashlight body 1, the connecting component 3 passes through a lower surface of the bottom box 2, and the connecting component 3 can be detachable connected with the firearm, the connection component 3 is used to fix the flashlight to the firearm; in other embodiments, the bottom box 2 and the flashlight body 1 can also be integrally formed or adopt other fixed connection directions, such as snap-on, glue and so on.

An adjustment component 4 is arranged on the bottom box 2, the adjusting component 4 is connected with the connecting component 3, using to drive the movement of the connecting component 3, so that the connecting component 3 is connected or disconnected from the firearm.

The bottom box 2 comprises a box body 21 and a bottom cover 22. The bottom cover 22 is fixedly connected to the box body 21 by screws. The box body 21 and the bottom cover 22 are detachably connected to facilitate the assembly of the lateral locking mechanism.

The adjusting component 4 comprises an adjusting rod 41 and an adjusting handle 42, one end of the adjusting rod 41 is fixedly connected with the adjusting handle 42; One end of the adjusting rod 41 away from the adjusting handle 42 passes through the side wall of the box body 21. The outer wall of the end of the adjusting rod 41 extending into the box body 21 is arranged with an external thread 43 which is connected with the connecting component 3. During operation, by rotating the adjusting handle 42, the adjusting rod 41 and the external thread 43 can be driven to rotate, thereby driving the connecting assembly 3 to move, and fixing the lateral locking mechanism on the firearm.

One end of the adjusting handle 42 is in contact with the outer side wall of the bottom box 21, a circlip 44 is sleeved on the adjusting rod 41, the circlip 44 is in contact with the inner side wall of the bottom box 21, and another end of the adjusting rod 41 away from the adjustment handle 42 is arranged with a first bearing 45, and the first bearing 45 is fixedly connected with the inner wall of the bottom box 21. By arranging the first bearing 45 and the circlip 44, the adjusting rod 41 and the box body 21 are limited in position, ensuring that the adjusting rod 41 can only rotate on the spot when working, and improving the stability of the lateral locking mechanism.

Two first waterproof gaskets 46 are sleeved on the outer side wall of the adjustment rod 41, the first waterproof gasket 46 are respectively limited at the connection between the adjustment rod 41 and the side wall of the box body 21, and the first waterproof gasket 46 are respectively sealed connected with the box body 21. By arranging the first waterproof gasket 46, the waterproofness of the lateral locking mechanism can be improved, and the service life of the flashlight can be prolonged.

In order to enable the adjustment handle 42 to quickly assemble and disassemble the lateral locking mechanism, anti-slip bumps 421 are arranged in an array on the side wall of the adjustment handle 42, and these anti-slip bumps 421 form three closed circles, and two card grooves 422 are arranged between the three circles. The card grooves 422 are respectively sleeved with anti-skid decorative rubber rings 47, and the anti-skid decorative rubber rings 47 are fixedly connected with the card grooves 422. When the adjusting handle 42 is rotated, the anti-slip bumps 421 and the anti-slip decorative rubber ring 47 can improve the friction force on the surface of the adjusting handle 42, prevent slippage, and improve the disassembly and assembly efficiency.

A long groove 423 is provided on the end face of the adjusting handle 42 away from the box body 21, and the long groove 423 can be adapted to a common screwdriver; when the lateral locking mechanism is stuck and locked, the adjusting handle 42 cannot be rotated by hand in this case, the lateral locking mechanism can be disassembled and assembled by a screwdriver against the long groove 423, which improves the practicability of the lateral locking mechanism. In other embodiments, the long groove 423 can also be set as a cross groove or any other shape suitable for existing tools.

The connecting component 3 comprises a connecting rod 31 and a fixing base 32. One end of the connecting rod 31 is fixedly connected to the fixing base 32; the fixing base 32 is used for connecting with the firearm, and different fixing bases 32 can be replaced according to different installation requirements. In this embodiment, the fixed seat 32 adopts the M-LOK special nut commonly used on firearms. The end of the connecting rod 31 away from the fixed seat 32 passes through the lower surface of the bottom cover 22, and the outer side of one end of the connecting rod 31 extending into the box body 21 is sleeved with a gear 33, the connecting rod 31 can rotate with the gear 33, and the gear 33 meshes with the external thread 43. In this embodiment, the included angle between the connecting rod 31 and the adjusting rod 41 is 90°; of course, in other embodiments, the included angle between the connecting rod 31 and the adjusting rod 41 can also be any other angle, as long as the two can be linked together.

One end of the connecting rod 31 away from the fixing base 32 is sleeved with a second bearing 34, and the second bearing 34 is fixedly connected with the inner wall of the box body 21; It can rotate in place in the box body 21.

The gear 33 is arranged with engaging teeth 331 in an array, and each engaging teeth 331 are in the shape of an inwardly curved arc, and the curved arc of the engaging teeth 331 is adapted to the outer wall of the external thread 43, so that the engaging teeth 331 can Seamless bite with the external thread 43. The transmission effect of the gear 33 and the external thread 43 is effectively improved, and the linkage loss is reduced.

In order to improve the waterproofness of the lateral locking mechanism, two second waterproof gasket 35 are sleeved on the outer side wall of the connecting rod 31, and the second waterproof gasket 35 are limited at the connection between the connecting rod 31 and the bottom cover 22. The second waterproof gasket 35 are tightly connected with the bottom cover 22. By arranging the second waterproof gasket 35, the waterproofness of the lateral locking mechanism can be improved, and the service life of the flashlight can be prolonged.

In order to improve the connection stability between the lateral locking mechanism and the firearm, in this embodiment, there are two connecting component 3 and two adjusting component 4, and the connecting component 3 and adjusting component 4 are respectively limited and fixed on the bottom box 2, and each adjustment handle 42 is respectively used to adjust a corresponding connecting component 3 to rotate. In other embodiments, the number of the connection component 3 and the adjustment component 4 can also be other numbers, or one adjustment handle 42 can adjust the movement of multiple connection components 3 at the same time; as long as the adjustment handle 42 can control the adjustment components 4 and the connection components 3.

The installation and disassembly process of the flashlight is as follows: when the flashlight needs to be installed, the fixing base 32 is first placed on the pre-installation position of the firearm, and by rotating the adjusting handle 42, the adjusting rod 41 is driven to rotate, and the adjusting rod 41 drives the external thread 43 to rotate, driving the gear 33 rotates, the gear 33 drives the connecting rod 31 to rotate, and the connecting rod 31 drives the fixing base 32 to rotate, so that the fixing base 32 is fixedly connected with the firearm, and the fixed installation of the flashlight is completed. When the flashlight needs to be removed from the firearm, it is only necessary to reversely rotate the adjusting handle 42, and the flashlight can be removed from the firearm through the linkage between the adjusting rod 41 and the connecting rod 31, which is convenient for storage.

Figure 4:
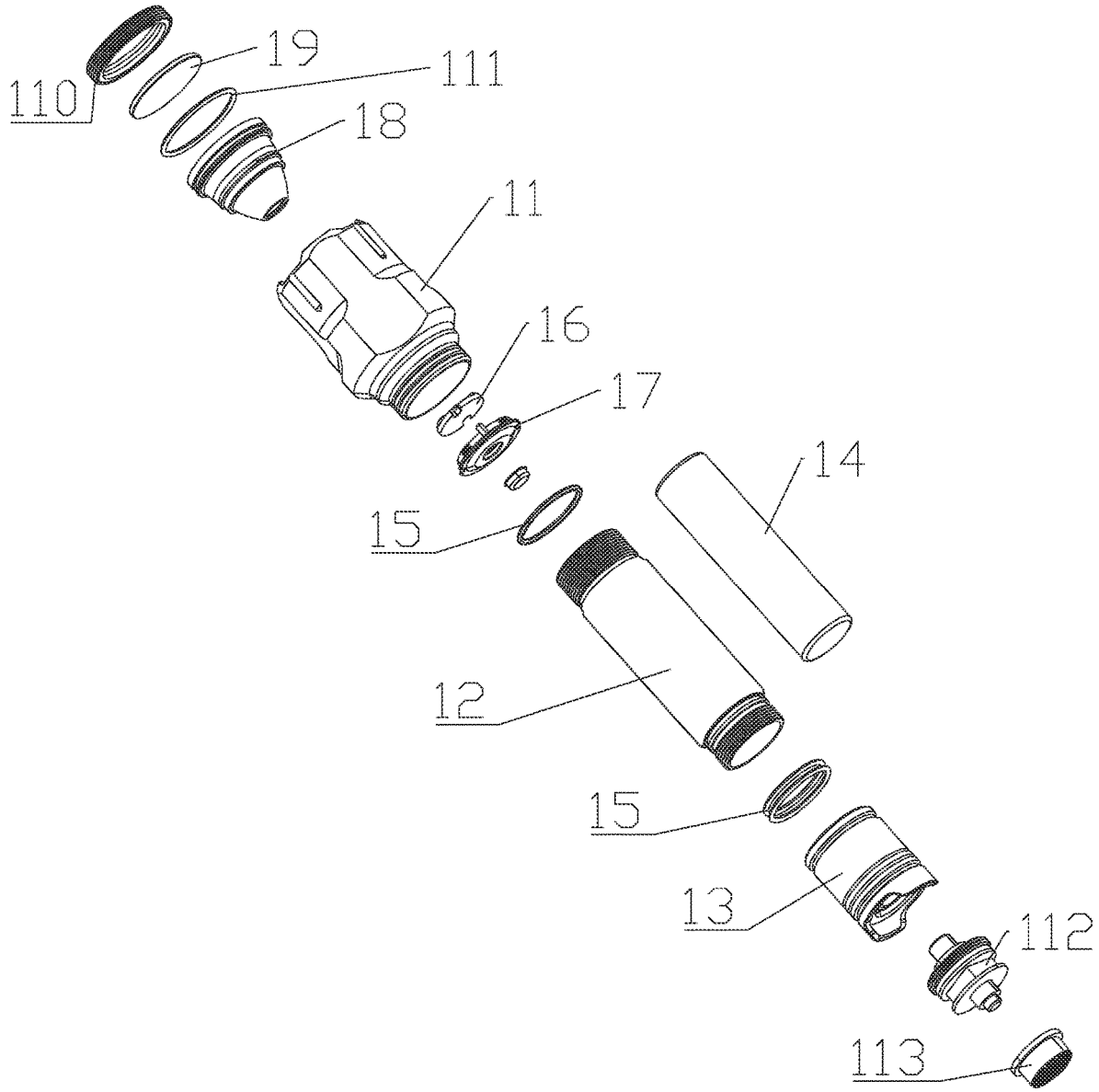
FIG. 4 is a schematic diagram of the exploded structure of the flashlight body according to the embodiment of the present disclosure.

As shown in FIG. 4, the flashlight body 1 comprises a lamp cap 11, a barrel body 12 and a back cover 13. Both ends of the barrel body 12 are screwed with the lamp cap 11 and the back cover 13 respectively, and the outer wall of the barrel body 12 is fixed connected with the box body 21 by screws. In other embodiments, the barrel body 12 and the box body 21 may also be integrally formed or adopt other fixed connection directions, such as snap connection, glue connection, and the like.

The barrel body 12 is arranged with a power supply 14, and the threaded connection between the rear cover 13 and the barrel body 12 can be unscrewed to realize the replacement of the power supply 14; in this embodiment, the power supply 14 is a dry battery, and in other embodiments, the power supply 14 can also be battery etc.

Both ends of the barrel body 12 are respectively sleeved with a third waterproof gasket 15, the third waterproof gasket 15 is limited at the connection between the barrel body 12, the lamp holder 11 and the back cover 13, and the third waterproof gasket 15 is respectively sealed connected with the lamp holder 11 and the back cover 13. The arrangement of the third waterproof gasket 15 can improve the waterproofness of the connection between the barrel body 12, the lamp cap 11 and the back cover 13, and improve the service life of the flashlight.

The lamp cap 11 is arranged with a light-emitting component. The light-emitting component comprises a light-emitting chip 16 and a chip limit bracket 17. The light-emitting chip 16 is electrically connected to the power supply 14 for lighting. The light-emitting chip 16 is fixed on the chip limit bracket 17. The limiting bracket 17 is fixedly connected with the lamp cap 11. The front end of the lamp cap 11 is arranged with a condensing assembly, which comprises a condensing cup 18, a transparent glass 19 and a sealing cover 110. One end of the condensing cup 18 is connected to the light-emitting chip 16, and the other end is abutted to the transparent glass 19, which is transparent. The side of the glass 19 away from the condenser cup 18 is in contact with the sealing cover 110, and the sealing cover 110 is screwed with the lamp cap 11.

The inner wall of the condenser cup 18 is a reflective mirror surface, and the cross-sectional area of one end of the condenser cup 18 close to the light-emitting chip 16 is smaller than the cross-sectional area of the other end of the condenser cup 18; the installation of the condenser cup 18 can extend the illumination distance of the flashlight. The condenser cup 18 is limited in the lamp cap 11, the outer wall of the condenser cup 18 is in contact with the inner wall of the lamp cap 11, a fourth waterproof gasket 111 is sleeved on the condenser cup 18, and the fourth waterproof gasket 111 is limited in the condenser cup 18 at the connection with the lamp cap 11, the fourth waterproof gasket 111 is sealed with the inner wall of the lamp cap 11.

A control switch 112 is fixed in the back cover 13, the control switch 112 is electrically connected with the light-emitting chip 16, the control switch 112 is sealed and connected with the back cover 13, and a key cap 113 is provided on the control switch 112, and the key cap 113 is connected with the control switch 112 abuts, and the outer wall of the key cap 113 is sealed with the back cover 13. By pressing the key cap 113, the force is transmitted to the control switch 112, thereby controlling the on and off of the flashlight.

Obviously, the above-described embodiments are only a part of the embodiments of the present disclosure, rather than all of the embodiments. The accompanying drawings show the preferred embodiments of the present disclosure, but do not limit the patent scope of the present disclosure. This disclosure may be embodied in many different forms, rather these embodiments are provided so that a thorough and complete understanding of the disclosure is provided. Although the present disclosure has been described in detail with reference to the foregoing embodiments, those skilled in the art can still modify the technical solutions described in the foregoing specific embodiments, or perform equivalent replacements for some of the technical features. Any equivalent structures made by using the contents of the description and drawings of this disclosure, which are directly or indirectly used in other related technical fields, are all within the scope of protection of this disclosure.

What is claimed is:

1. A flashlight with lateral locking function for firearms, comprising: a flashlight body and a lateral locking mechanism, the flashlight body is connected with the lateral locking mechanism, and the lateral locking mechanism is used to fix the flashlight body to a firearm;

the lateral locking mechanism comprises a bottom box and a connecting component, an upper surface of the bottom box is connected with the flashlight body, the connecting component passes through a lower surface of the bottom box, and the connecting component can be detachable connected with the firearm;

an adjustment component is arranged on the bottom box, the adjusting component is connected with the connecting component, and comprises an adjusting rod and an adjusting handle, one end of the adjusting rod is connected with the adjusting handle, acid the adjusting handle is connected with a side wall of the bottom box, using to drive the movement of the connecting component, so that the connecting component is connected or disconnected from the firearm, another end of the adjusting rod away from the adjusting handle passes through the side wall of the bottom box, and the outer wall of one end of the adjusting rod extending into the bottom box is arranged with an external thread;

the connecting component comprises a connecting rod and a fixing base, one end of the connecting rod is connected with the fixing base, and the fixing base is used for connecting with the firearm;

another end of the connecting rod away from the fixing base passes through the lower surface of the bottom box, and the outer side of one end of the connecting rod that extends into the bottom box is sleeved with a gear, and the connecting rod can rotate with the gear, the gear meshes with the external thread; the gear is arranged with engaging teeth in an array, the engaging teeth are in the shape of an inwardly curved arc, and the curved arc of the engaging teeth is suitable match for the outer wall of the external thread.

2. The flashlight with lateral locking function for firearms according to claim 1, wherein one end of the adjusting handle is in contact with the outer side wall of the bottom box, a circlip is sleeved on the adjusting rod, the circlip is in contact with the timer side wall of the bottom box, and another end of the adjusting rod away from the adjustment handle is arranged with a first bearing, and the first bearing is connected with the inner wall of the bottom box.

3. The flashlight with lateral locking function for firearms according to claim 1, wherein the side wall of the adjusting handle is arranged with an anti-skid structure, and the end surface of the adjusting handle away from the bottom box is arranged with a long groove.

4. The flashlight with lateral locking function for firearms according to claim 2, wherein a second bearing is sleeved at one end of the connecting rod away from the fixing base, and the second bearing is connected with the inner wall of the bottom box.

5. The flashlight with lateral locking function for firearms according to claim 1, wherein there are two adjustment components and two connection components respectively, and each adjustment handle is used to adjust a corresponding connection component.

6. The flashlight with lateral locking function for firearms according to claim 5, wherein the flashlight body comprises a lamp cap, a barrel body and a back cover, two ends of the barrel body are respectively connected with the lamp cap and the back cover, and an outer wall of the barrel body is connected with the upper surface of the bottom box.

7. The flashlight with lateral locking function for firearms according to claim 6, wherein the lamp cap is arranged with a light-emitting component, the barrel body is arranged with a power supply, and the back cover is arranged with a control switch, and the light-emitting component is respectively electrically connected with the power supply and the control switch.

8. The flashlight with lateral locking function for firearms according to claim 7, wherein both ends of the barrel body are respectively sleeved with waterproof rings, and the waterproof rings are respectively sealed and connected with the lamp cap and the back cover.

* * * * *